US011971201B2

(12) United States Patent
Hirayama et al.

(10) Patent No.: US 11,971,201 B2
(45) Date of Patent: Apr. 30, 2024

(54) COMPRESSOR AND REFRIGERATION CYCLE DEVICE

(71) Applicant: Toshiba Carrier Corporation, Kawasaki (JP)

(72) Inventors: Takuya Hirayama, Fuji (JP); Shogo Shida, Fuji (JP)

(73) Assignee: Toshiba Carrier Corporation, Kawasaki (JP)

( * ) Notice: Subject to any disclaimer, the term of this patent is extended or adjusted under 35 U.S.C. 154(b) by 357 days.

(21) Appl. No.: 17/305,736

(22) Filed: Jul. 14, 2021

(65) Prior Publication Data

US 2021/0341188 A1 Nov. 4, 2021

Related U.S. Application Data

(63) Continuation of application No. PCT/JP2019/002635, filed on Jan. 28, 2019.

(51) Int. Cl.
*F25B 31/02* (2006.01)
*F25B 41/40* (2021.01)

(52) U.S. Cl.
CPC ..... *F25B 31/026* (2013.01); *F25B 41/40* (2021.01); *F04C 2240/804* (2013.01)

(58) Field of Classification Search
CPC ... F04C 2240/804; F25B 31/026; F25B 41/41
See application file for complete search history.

(56) References Cited

U.S. PATENT DOCUMENTS

2008/0267804 A1* 10/2008 Morozumi ..... F04C 23/001 418/60
2010/0054978 A1* 3/2010 Ueda ..... F04C 29/0007 418/60

FOREIGN PATENT DOCUMENTS

CN 101387298 A 3/2009
CN 104074764 A 10/2014
CN 106415015 A 2/2017
(Continued)

OTHER PUBLICATIONS

English Translation of WO-2005124156-A1 obtained Aug. 30, 2021 (Year: 2015).*
(Continued)

*Primary Examiner* — Connor J Tremarche
(74) *Attorney, Agent, or Firm* — Oblon, McClelland, Maier & Neustadt, L.L.P.

(57) ABSTRACT

A compressor of an embodiment includes three suction pipes. A first center of a first suction pipe, a second center of a second suction pipe, and a third center of a third suction pipe are positioned at vertices of a triangle. A first distance between the first center and a center of a compressor main body is smaller than a second distance between the second center and the center of the compressor main body and a third distance between the third center and the center of the compressor main body. The first suction pipe is connected to a first suction port on an uppermost side. A second virtual plane on which a central axis of a main curved pipe part of the second suction pipe is disposed and a third virtual plane on which a central axis of a main curved pipe part of the third suction pipe is disposed are inclined to opposite sides from each other with respect to a first virtual plane on which a central axis of a main curved pipe part of the first suction pipe is disposed.

6 Claims, 5 Drawing Sheets

(56) References Cited

FOREIGN PATENT DOCUMENTS

| | | | | |
|---|---|---|---|---|
| JP | 2008-274844 | A | 11/2008 | |
| JP | 2016-048032 | A | 4/2016 | |
| WO | WO 2005/124156 | A1 | 12/2005 | |
| WO | WO-2005124156 | A1 * | 12/2005 | ..... F04C 18/3564 |

OTHER PUBLICATIONS

International Search Report dated Apr. 16, 2019 in PCT/JP2019/002635 filed on Jan. 28, 2019, 2 pages (with English Translation).
Combined Chinese Office Action and Search Report dated Jul. 26, 2022 in Chinese Patent Application No. 201980088169.8 (with English Translation of Search Report only), 8 pages.

* cited by examiner

COMPRESSOR AND REFRIGERATION CYCLE DEVICE

CROSS-REFERENCE TO RELATED APPLICATIONS

This is a Continuation Applications of International Application No. PCT/JP2019/002635, filed on Jan. 28, 2019; the entire contents of which are incorporated herein by reference.

FIELD

Embodiments described herein relate generally to a compressor and a refrigeration cycle device.

BACKGROUND

A refrigeration cycle device includes a compressor which compresses a gaseous refrigerant. The compressor includes a compressor main body and an accumulator. The accumulator performs gas-liquid separation of a refrigerant and supplies a gaseous refrigerant to the compressor main body.

Compressors are required to be made compact.

DETAILED DESCRIPTION

Figure 1:
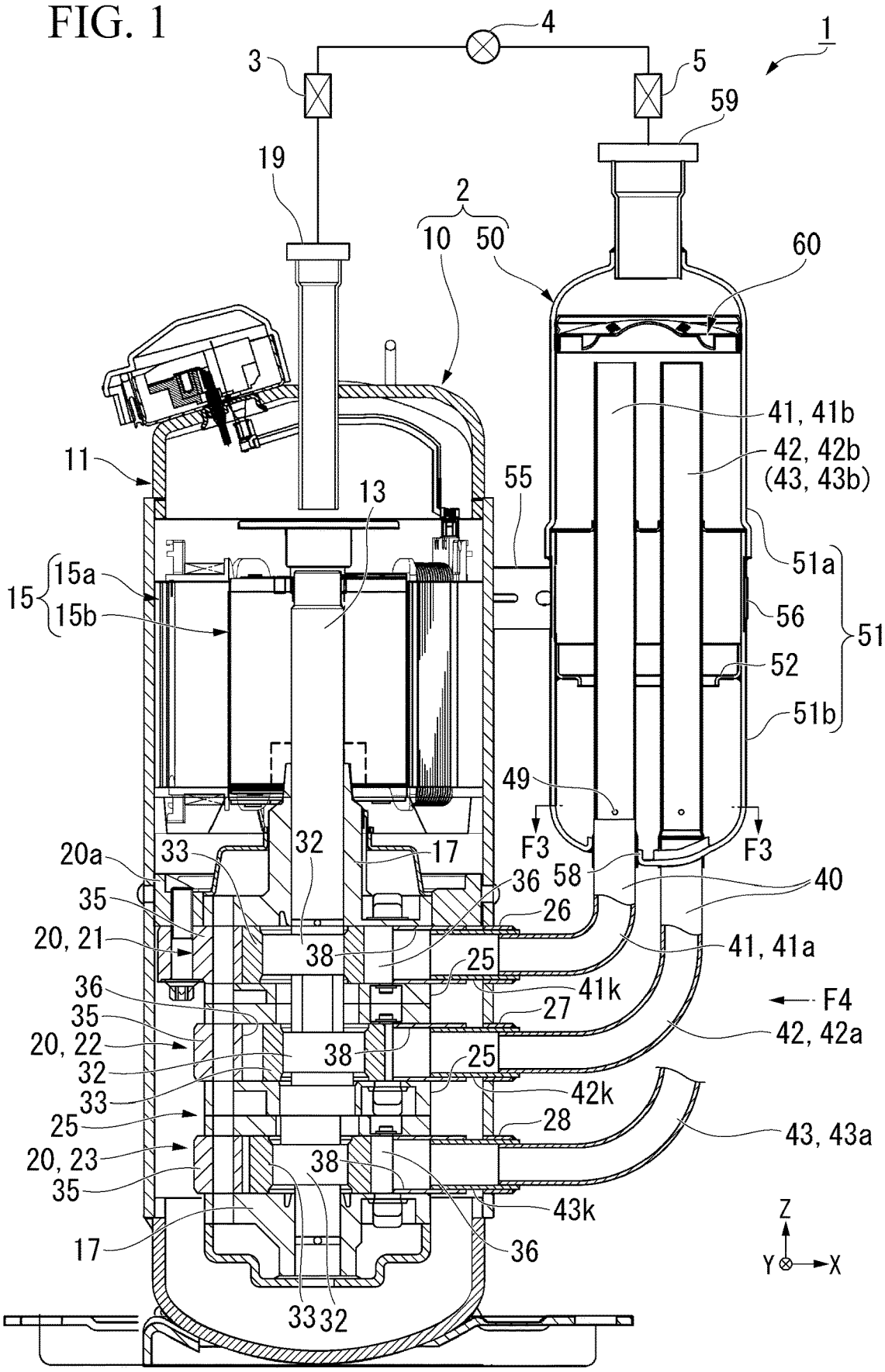
FIG. 1 is a schematic configuration view of a refrigeration cycle device of an embodiment including a cross-sectional view of a compressor.

A compressor of the embodiment includes a compressor main body, an accumulator, and three suction pipes. The compressor main body houses a plurality of compression mechanism units and an electric motor unit driving the plurality of compression mechanism units in a case. The accumulator is supported by the compressor main body and includes a refrigerant introduction part at an upper portion thereof. The three suction pipes penetrate a bottom portion of the accumulator, have one end sides which open inside the accumulator, and have the other end sides connected to three suction ports provided in the case. The three suction pipes are a first suction pipe, a second suction pipe, and a third suction pipe. The three suction pipes are disposed so that a first center, a second center, and a third center are positioned at vertices of a triangle as viewed from above the accumulator. The first center is a center of a first flow path cross section of the first suction pipe at a portion penetrating the bottom portion of the accumulator. The second center is a center of a second flow path cross section of the second suction pipe. The third center is a center of a third flow path cross section of the third suction pipe. The first suction pipe is disposed so that a first distance is smaller than a second distance and a third distance. The first distance is a distance between the first center and a center of the compressor main body. The second distance is a distance between the second center and the center of the compressor main body. The third distance is a distance between the third center and the center of the compressor main body. The other end side of the first suction pipe is connected to a first suction port which is positioned uppermost among the three suction ports. The three suction pipes include main curved pipe parts which are curved from below the accumulator toward the three suction ports. A second virtual plane and a third virtual plane are inclined to opposite sides from each other with respect to a first virtual plane. The first virtual plane is a plane on which a central axis of the main curved pipe part of the first suction pipe is disposed. The second virtual plane is a plane on which a central axis of the main curved pipe part of the second suction pipe is disposed. The third virtual plane is a plane on which a central axis of the main curved pipe part of the third suction pipe is disposed.

Hereinafter, a compressor 2 and a refrigeration cycle device 1 of embodiments will be described with reference to the drawings.

In the present application, an X direction, a Y direction, and a Z direction of an orthogonal coordinate system will be defined as follows. The X direction is a direction in which a compressor main body 10 and an accumulator 50 are aligned, and a +X direction is a direction from the compressor main body 10 toward the accumulator 50. The Z direction is a direction parallel to a central axis of the compressor main body 10, and a +Z direction is a direction from a compression mechanism unit 20 to an electric motor unit 15. The Y direction is a direction perpendicular to the X direction and the Z direction. For example, the X direction and Y direction are horizontal directions. For example, the Z direction is a vertical direction, and the +Z direction is vertically upward.

The refrigeration cycle device 1 will be briefly described.

FIG. 1 is a schematic configuration view of the refrigeration cycle device 1 of an embodiment including a cross-sectional view of the compressor 2.

As illustrated in FIG. 1, the refrigeration cycle device 1 includes a compressor 2, a radiator (for example, a condenser) 3 connected to the compressor 2, an expansion device (for example, an expansion valve) 4 connected to the radiator 3, and a heat absorber (for example, an evaporator) 5 connected to the expansion device 4. The refrigeration cycle device 1 contains a refrigerant such as R410A, R32, or carbon dioxide ($CO_2$). The refrigerant circulates in the refrigeration cycle device 1 while changing its phase.

The compressor 2 is a so-called rotary-type compressor. The rotary compressor 2, for example, compresses a low-pressure gaseous refrigerant (fluid) taken into the inside to obtain a high-temperature and high-pressure gaseous refrigerant. Further, a specific configuration of the compressor 2 will be described later.

The radiator 3 radiates heat from the high-temperature and high-pressure gaseous refrigerant discharged from the compressor 2.

The expansion device 4 reduces a pressure of the high-pressure refrigerant sent from the radiator 3 to convert the high-pressure refrigerant into a low-temperature and low-pressure liquid refrigerant.

The heat absorber 5 evaporates the low-temperature and low-pressure liquid refrigerant sent from the expansion device 4 to convert the low-temperature and low-pressure liquid refrigerant into a low-pressure gaseous refrigerant. In the heat absorber 5, evaporation of the low-pressure liquid refrigerant takes evaporation heat from the surroundings, and thus the surroundings are cooled. Further, the low-pressure gaseous refrigerant that has passed through the heat absorber 5 is taken into the compressor 2 described above.

As described above, in the refrigeration cycle device 1 of the present embodiment, a refrigerant serving as a working fluid circulates while changing its phase between a gaseous refrigerant and a liquid refrigerant, and heating, cooling, or the like is performed by utilizing such heat radiation and heat absorption.

The compressor 2 of the embodiment will be described.

The compressor 2 includes the compressor main body 10 and the accumulator 50.

The compressor main body 10 includes a shaft 13, the electric motor unit 15 that rotates the shaft 13, a plurality of compression mechanism units 20 that compress a gaseous refrigerant due to rotation of the shaft 13, and a cylindrical case 11 that houses the shaft 13, the electric motor unit 15, and the compression mechanism units 20.

The shaft 13 is disposed along the central axis of the compressor main body 10.

The electric motor unit 15 is disposed in the +Z direction of the shaft 13. The electric motor unit 15 includes a stator 15*a* and a rotor 15*b*. The stator 15*a* is fixed to an inner circumferential surface of the case 11. The rotor 15*b* is fixed to an outer circumferential surface of the shaft 13. The electric motor unit 15 rotates the shaft 13 inside the case 11.

The case 11 is formed in a cylindrical shape with both end portions closed. The case 11 includes a discharge part 19 at an upper end portion. The discharge part 19 is formed by a pipe and is disposed along a central axis of the case 11. The discharge part 19 has a discharge port at an upper end portion. The discharge part 19 discharges the gaseous refrigerant inside the case 11 from the discharge port.

The plurality of compression mechanism units 20 are disposed in a −Z direction of the shaft 13. The plurality of compression mechanism units 20 include three compression mechanism units 20 including, for example, a first compression mechanism unit 21, a second compression mechanism unit 22, and a third compression mechanism unit 23. The first compression mechanism unit 21, the second compression mechanism unit 22, and the third compression mechanism unit 23 are disposed to be aligned in that order from the +Z direction to the −Z direction. The first compression mechanism unit 21 is positioned uppermost in the +Z direction among the plurality of compression mechanism units 20. Hereinafter, a configuration of the first compression mechanism unit 21 will be described as a representative. Configurations of the second compression mechanism unit 22 and the third compression mechanism unit 23 are the same as those of the first compression mechanism unit 21 except for a direction of eccentricity of an eccentric part 32.

The first compression mechanism unit 21 includes the eccentric part 32, a roller 33, a cylinder 35, a bearing 17, and a partition plate 25.

The eccentric part 32 is formed integrally with the shaft 13 in a columnar shape. When viewed from the +Z direction, a center of the eccentric part 32 is eccentric from a central axis of the shaft 13.

The roller 33 is formed in a cylindrical shape and is disposed along an outer circumference of the eccentric part 32.

The cylinder 35 is fixed to a frame 20*a*. An outer circumferential surface of the frame 20*a* is fixed to an inner circumferential surface of the case 11. The cylinder 35 includes a cylinder chamber 36, a vane (not illustrated), and a suction hole 38. The cylinder chamber 36 houses the eccentric part 32 and the roller 33 inside. The vane is housed in a vane groove formed in the cylinder 35 and can advance into and retreat from the inside of the cylinder chamber 36. The vane is biased such that a distal end portion thereof is brought into contact with an outer circumferential surface of the roller 33. The vane, together with the eccentric part 32 and the roller 33, partitions the inside of the cylinder chamber 36 into a suction chamber and a compression chamber. The suction hole 38 is formed from an outer circumferential surface of the cylinder 35 to the cylinder chamber 36. The suction hole 38 introduces the gaseous refrigerant into the suction chamber of the cylinder chamber 36. A first suction port 26 is provided in the case 11 to face the suction hole 38. Similarly, a second suction port 27 is provided to face the suction hole 38 of the second compression mechanism unit 22, and a third suction port 28 is provided to face the suction hole 38 of the third compression mechanism unit 23. The three suction ports 26, 27, and 28 are formed to protrude outward in a radial direction from the case 11.

The bearing 17 and the partition plate 25 are disposed on both sides of the cylinder 35 in the Z direction and close both end portions of the cylinder chamber 36 in the Z direction. The bearing 17 and the partition plate 25 have a discharge hole for discharging the gaseous refrigerant compressed in the compression chamber of the cylinder chamber 36 to the inside of the case 11.

An operation of the first compression mechanism unit 21 will be described.

When the electric motor unit 15 rotates the shaft 13, the eccentric part 32 and the roller 33 rotate eccentrically inside the cylinder chamber 36. When the roller 33 rotates eccentrically, the gaseous refrigerant is suctioned into the suction chamber of the cylinder chamber 36, and the gaseous refrigerant in the compression chamber is compressed. The compressed gaseous refrigerant is discharged from the discharge hole of the bearing 17 and the partition plate 25 to the inside of the case 11. The gaseous refrigerant inside the case 11 is discharged from the discharge part 19 to the outside of the case 11.

The accumulator 50 will be described.

The accumulator 50 includes a case 51, a strainer plate 60, and a plurality of suction pipes 40, and separates an introduced refrigerant into a gaseous refrigerant and a liquid refrigerant. The liquid refrigerant is stored in a bottom portion of the case 51, and the gaseous refrigerant is supplied to the compressor main body 10 through the plurality of suction pipes 40.

The case 51 is formed in a cylindrical shape with both end portions closed. The case 51 is formed by connecting a first case 51*a* in the +Z direction and a second case 51*b* in the −Z direction. Through holes 58 through which the plurality of suction pipes 40 pass are formed in the bottom portion of the case 51. The case 51 is supported by the compressor main body 10 via a bracket 55 and a belt 56 (see FIG. 2).

The case 51 includes a refrigerant introduction part 59 and a retainer 52.

The introduction part 59 is provided at an upper end portion of the case 51. The introduction part 59 is formed by a pipe and is disposed along a central axis of the case 51.

The retainer 52 is formed in a ring shape, and an outer circumferential surface thereof is fixed to an inner circumferential surface of the case 51.

The strainer plate 60 is disposed inside the case 51 in the +Z direction, and captures foreign substances contained in the refrigerant introduced from the introduction part 59.

The plurality of suction pipes 40 will be described in detail.

The plurality of suction pipes 40 are three suction pipes including a first suction pipe 41, a second suction pipe 42, and a third suction pipe 43. The three suction pipes 41, 42, and 43 are provided through the through holes 58 formed in the bottom portion of the case 51. End portions (one end sides) of the three suction pipes 41, 42, and 43 in the +Z direction open inside the case 51. End portions (the other end sides) of the three suction pipes 41, 42, and 43 in the −Z direction are connected to the three suction ports 26, 27, and 28 of the compressor main body 10.

Figure 2:
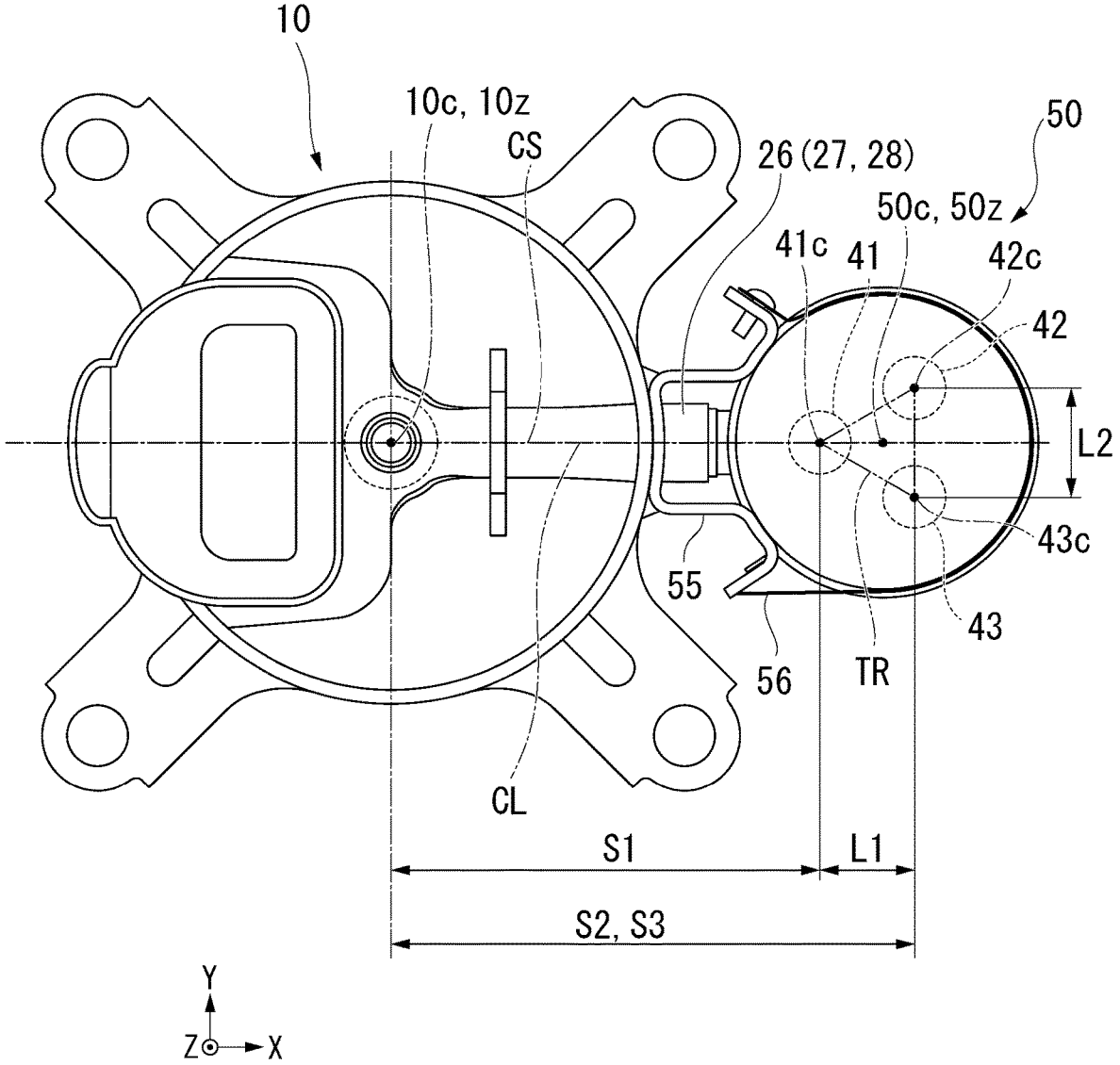
FIG. 2 is a plan view of the compressor of the embodiment.
Figure 3:
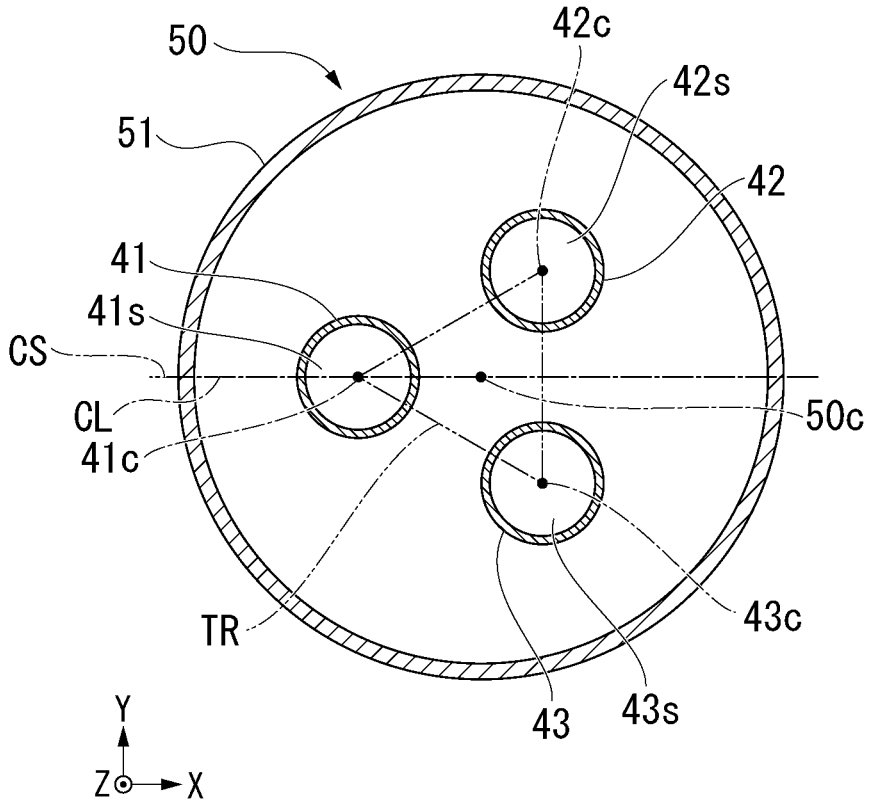
FIG. 3 is a cross-sectional view along line F3-F3 of FIG. 1.

FIG. 2 is a plan view of the compressor 2 of the embodiment. FIG. 3 is a cross-sectional view along line F3-F3 of FIG. 1. FIG. 3 illustrates a cross section of a portion in which the three suction pipes 41, 42, and 43 penetrate the bottom portion of the case 51 of the accumulator 50. A first center 41*c* of a first flow path cross section 41*s* of the first suction pipe 41, a second center 42*c* of a second flow path cross section 42*s* of the second suction pipe 42, and a third center 43*c* of a third flow path cross section 43*s* of the third suction pipe 43 are defined as illustrated in FIG. 3. The first center 41*c*, the second center 42*c*, and the third center 43*c* are positioned at vertices of a triangle TR as viewed from the +Z direction. Thereby, the three suction pipes 41, 42, and 43 are disposed close to each other compared to a case in which three suction pipes 41, 42, and 43 are disposed to be aligned in a line as viewed from the +Z direction. Therefore, the accumulator 50 is made compact. In the example of FIG. 3, the triangle TR is an equilateral triangle. All interior angles of the triangle TR are less than 90 degrees (acute angles). Thereby, the three suction pipes 41, 42, and 43 are disposed close to each other compared to a case in which one interior angle of the triangle TR is 90 degrees or more (an obtuse angle). Therefore, the accumulator 50 is made compact.

When the accumulator 50 is made compact, components for an accumulator having two suction pipes can be used for components of the accumulator 50.

The compressor main body 10 vibrates in accordance with eccentric rotation of the eccentric part 32 and the roller 33. When the accumulator 50 is made compact, a distance between a center 10*c* of the compressor main body 10 and a center 50*c* of the accumulator 50 decreases as illustrated in FIG. 2. Thereby, vibrations of the accumulator 50 according to the vibrations of the compressor main body 10 are suppressed.

A first distance S1 in the X direction between the first center 41*c* and the center 10*c* of the compressor main body 10, a second distance S2 in the X direction between the second center 42*c* and the center 10*c* of the compressor main body 10, and a third distance S3 in the X direction between the third center 43*c* and the center 10*c* of the compressor main body 10 are defined as illustrated in FIG. 2. The first distance S1 is smaller than the second distance S2 and the third distance S3. In other words, the first suction pipe 41 is disposed closer to the compressor main body 10 than the second suction pipe 42 and the third suction pipe 43 are. In the example of FIG. 2, the second distance S2 and the third distance S3 are equal.

Figure 4:
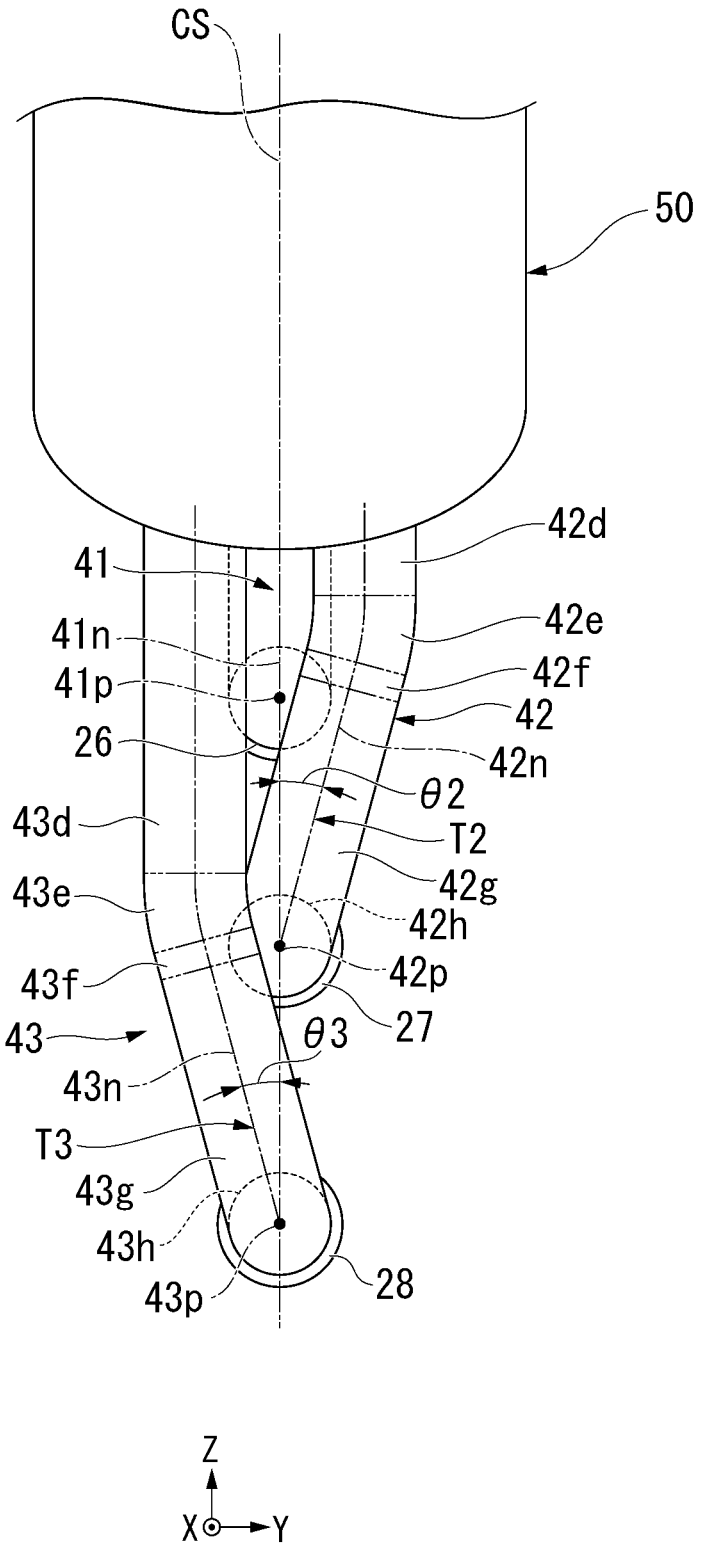
FIG. 4 is a side view of external suction pipes as viewed from an F4 direction of FIG. 1.

FIG. 4 is a side view of external suction pipes as viewed from an F4 direction of FIG. 1. The three suction ports 26, 27, and 28 described above are disposed in the +Z direction, that is, disposed to overlap a reference plane CS to be described later as viewed from above the accumulator 50. The three suction ports 26, 27, and 28 are disposed at the same position as viewed from the +Z direction. The three suction ports 26, 27, and 28 open in the same +X direction. Thereby, the three suction pipes 41, 42, and 43 are connected from the same +X direction with respect to the three suction ports 26, 27, and 28. Therefore, connection work of the three suction pipes 41, 42, and 43 is simplified.

A lower end portion (end portion in the −Z direction and the −X direction) of the first suction pipe 41 is connected to the first suction port 26 positioned uppermost in the +Z direction among the three suction ports 26, 27, and 28. A lower end portion of the third suction pipe 43 is connected to the third suction port 28 positioned lowermost in the −Z direction. A lower end portion of the second suction pipe 42 is connected to the second suction port 27 positioned in the middle between the first suction port 26 and the third suction port 28 in the Z direction.

As illustrated in FIG. 1, the three suction pipes 41, 42, and 43 include internal suction pipes 41*b*, 42*b*, and 43*b*, external suction pipes 41*a*, 42*a*, and 43*a*, and end suction pipes 41*k*, 42*k*, and 43*k*, respectively. The internal suction pipes 41*b*, 42*b*, and 43*b* are disposed inside the case 51. The external suction pipes 41*a*, 42*a*, and 43*a* are disposed outside the case 51. The internal suction pipes 41*b*, 42*b*, and 43*b* and the external suction pipes 41*a*, 42*a*, and 43*a* are connected in the vicinity of the bottom portion of the case 51. Since the external suction pipes 41*a*, 42*a*, and 43*a* are in contact with air, the external suction pipes 41*a*, 42*a*, and 43*a* are formed of a copper material or the like having corrosion resistance. Since the internal suction pipes 41*b*, 42*b*, and 43*b* are not in contact with air, the internal suction pipes 41*b*, 42*b*, and 43*b* are formed of a low-cost steel material or the like. Further, the internal suction pipes 41*b*, 42*b*, and 43*b* and the external suction pipes 41*a*, 42*a*, and 43*a* may be integrally formed of the same material.

The internal suction pipes 41*b*, 42*b*, and 43*b* each have a linear central axis. The central axes of the internal suction pipes 41*b*, 42*b*, and 43*b* are parallel to the Z direction and are disposed parallel to the central axis of the case 51 of the accumulator 50. Upper end portions (end portions in the +Z direction) of the internal suction pipes 41*b*, 42*b*, and 43*b* open inside the case 51. Outflow holes 49 of a lubricating oil are formed in lower portions of the internal suction pipes 41*b*, 42*b*, and 43*b*. The lubricating oil accumulated in the lower portion of the case 51 flows out of the outflow holes 49 little by little to the internal suction pipes 41*b*, 42*b*, and 43*b*.

The end suction pipes 41*k*, 42*k*, and 43*k* are formed in a straight pipe shape. Central axes of the end suction pipes 41*k*, 42*k*, and 43*k* have a linear shape and are disposed parallel to the X direction. End portions of the end suction pipes 41*k*, 42*k*, and 43*k* in the +X direction are disposed on inner sides of the three suction ports 26, 27, and 28 of the compressor main body 10. End portions of the end suction pipes 41*k*, 42*k*, and 43*k* in the −X direction are disposed on inner sides of the three suction holes 38 of the cylinder 35. The end suction pipes 41*k*, 42*k*, and 43*k* are connected to the three suction ports 26, 27, and 28 by brazing or the like on an outer side of the compressor main body 10. Lower end portions of the external suction pipes 41*a*, 42*a*, and 43*a* are inserted into the inside of the end suction pipes 41*k*, 42*k*, and 43*k*. Thereby, the three suction pipes 41, 42, and 43 are connected to the three suction holes 38 of the cylinder 35. The external suction pipes 41*a*, 42*a*, and 43*a* and the end suction pipes 41*k*, 42*k*, and 43*k* may be integrally formed.

A first opening center 41*p* is defined as an opening center on a lower end side (end portion in the −Z direction and −X direction) of the first suction pipe 41. Specifically, the first opening center 41*p* is an opening center of the end suction pipe 41*k* in the −X direction. Similarly, a second opening center 42*p* is defined as an opening center on a lower end side of the second suction pipe 42. A third opening center 43*p* is defined as an opening center on a lower end side of the third suction pipe 43. The first opening center 41*p*, the second opening center 42*p*, and the third opening center 43*p* are included in the reference plane CS to be described later.

The external suction pipes 41*a*, 42*a*, and 43*a* will be described in detail.

Figure 5:
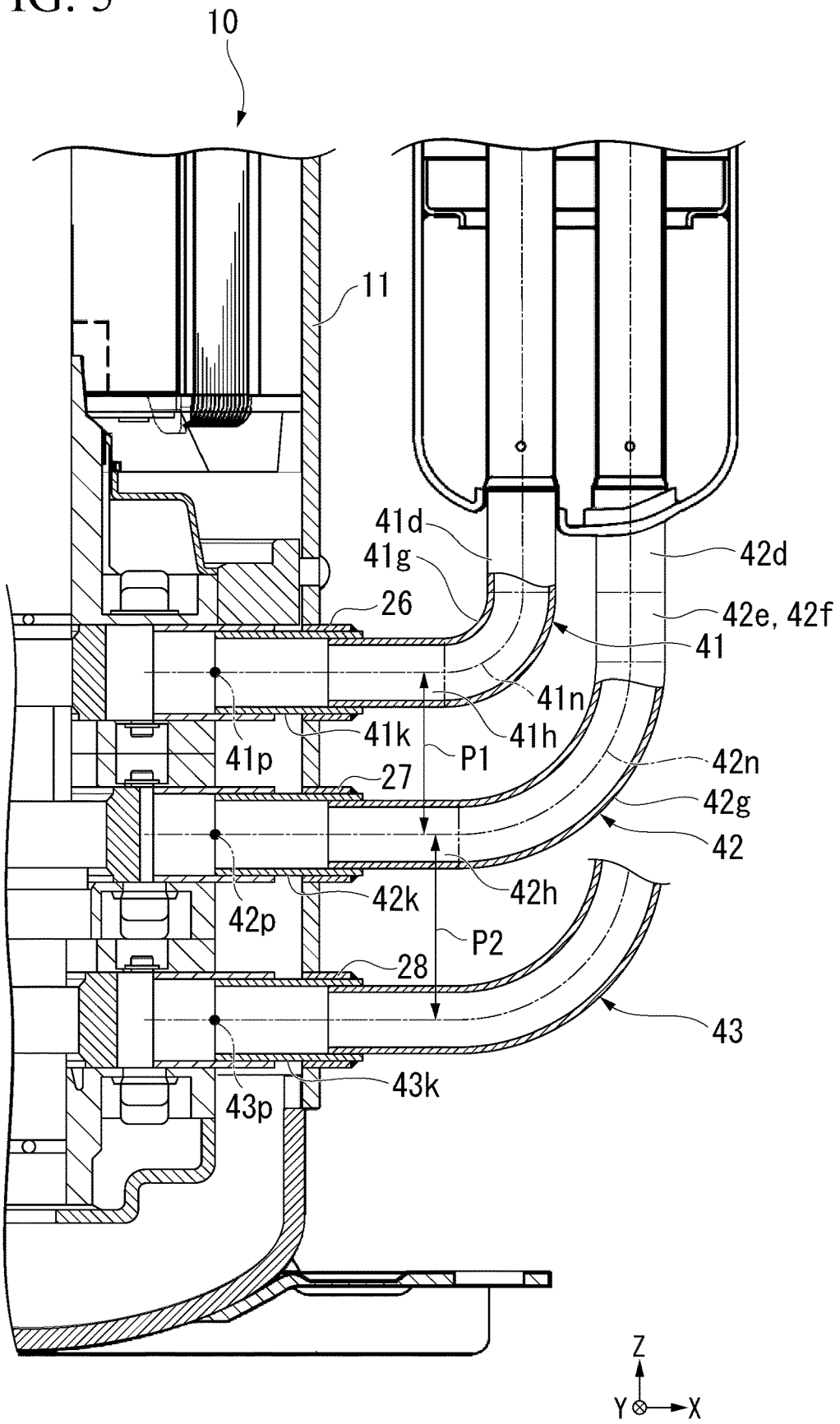
FIG. 5 is an enlarged view of a surrounding portion of the external suction pipes of FIG. 1.

FIG. 5 is an enlarged view of a surrounding portion of the external suction pipe of FIG. 1. The external suction pipe 41*a* of the first suction pipe 41 includes an upper straight pipe part 41*d*, a main curved pipe part 41*g*, and a lower straight pipe part 41*h*.

The upper straight pipe part 41*d* is disposed at an upper end portion (end portion in the +Z direction) of the external suction pipe 41*a*. The upper straight pipe part 41*d* is disposed at a portion penetrating the bottom portion of the accumulator 50. A central axis 41*n* of the upper straight pipe part 41*d* is linear and is disposed parallel to the Z direction.

The lower straight pipe part 41*h* is disposed at a lower end portion (end portion in the −Z direction and −X direction) of the external suction pipe 41*a*. The lower straight pipe part 41*h* is disposed at a connection portion between it and the end suction pipe 41*k*. The central axis 41*n* of the lower straight pipe part 41*h* is linear and is disposed parallel to the X direction.

The main curved pipe part 41*g* is disposed between the upper straight pipe part 41*d* and the lower straight pipe part 41*h*. The main curved pipe part 41*g* is curved from below the accumulator 50 toward the first suction port 26. The central axis 41*n* of the main curved pipe part 41*g* is a curve that is curved in the −X direction toward the −Z direction. As illustrated in FIG. 4, the central axis 41*n* of the main curved pipe part 41*g* is disposed in a plane parallel to an XZ plane. The reference plane (first virtual plane) CS is defined as a virtual plane including the central axis 41*n* of the main curved pipe part 41*g*. The entire central axis 41*n* of the first suction pipe 41 is included in the reference plane CS. When viewed from the +Z direction and the +X direction, the entire portion including the main curved pipe part 41*g* of the first suction pipe 41 overlaps the reference plane CS. The three suction ports 26, 27, and 28 of the compressor main body 10 overlap the reference plane CS as viewed from the +Z direction (from above the accumulator 50).

The external suction pipe 42*a* of the second suction pipe 42 includes an upper straight pipe part 42*d*, a sub-curved pipe part 42*e*, an intermediate straight pipe part 42*f*, a main curved pipe part 42*g*, and a lower straight pipe part 42*h*. The upper straight pipe part 42*d* of the second suction pipe 42 is formed in the same manner as the upper straight pipe part 41*d* of the first suction pipe 41. The lower straight pipe part 42*h* of the second suction pipe 42 is formed in the same manner as the lower straight pipe part 41*h* of the first suction pipe 41.

The sub-curved pipe part 42*e* is disposed in the −Z direction of the upper straight pipe part 42*d*. The sub-curved pipe part 42*e* is curved from an end portion of the upper straight pipe part 42*d* in the −Z direction toward the reference plane CS. A central axis 42*n* of the sub-curved pipe part 42*e* is a curve that is curved in the −Y direction toward the −Z direction. As illustrated in FIG. 5, the central axis 42*n* of the sub-curved pipe part 42*e* is disposed in a plane parallel to a YZ plane.

As illustrated in FIG. 4, the intermediate straight pipe part 42*f* is disposed in the −Z direction of the sub-curved pipe part 42*e*. The intermediate straight pipe part 42*f* extends in the −Z direction and the −Y direction from an end portion of the sub-curved pipe part 42*e* in the −Z direction. The central axis 42*n* of the intermediate straight pipe part 42*f* is linear. As illustrated in FIG. 5, the central axis 42*n* of the intermediate straight pipe part 42*f* is disposed in a plane parallel to the YZ plane.

The intermediate straight pipe part 42*f* is disposed between the sub-curved pipe part 42*e* and the main curved pipe part 42*g*. That is, the sub-curved pipe part 42*e* is disposed between the upper straight pipe part 42*d* and the intermediate straight pipe part 42*f*. The main curved pipe part 42*g* is disposed between the intermediate straight pipe part 42*f* and the lower straight pipe part 42*h*. Therefore, starting points of both end portions of the sub-curved pipe part 42*e* and the main curved pipe part 42*g* become clear. The sub-curved pipe part 42*e* is formed with an end portion of the upper straight pipe part 42*d* in the −Z direction and an end portion of the intermediate straight pipe part 42*f* in the +Z direction as references. The main curved pipe part 42*g* is formed with an end portion of the intermediate straight pipe part 42*f* in the −Z direction and an end portion of the lower straight pipe part 42*h* in the +X direction as references. Therefore, the sub-curved pipe part 42*e* and the main curved pipe part 42*g* are formed with high accuracy at a low cost.

The main curved pipe part 42*g* is disposed in the −Z direction of the intermediate straight pipe part 42*f*. The main curved pipe part 42*g* is curved from below the accumulator 50 toward the second suction port 27. The central axis 42*n* of the main curved pipe part 42*g* is a curve that is curved in the −X direction toward the −Z direction. As illustrated in FIG. 4, the main curved pipe part 42*g* extends in the −Z direction and the −Y direction from an end portion of the intermediate straight pipe part 42*f* in the −Z direction. The central axis 42*n* of the main curved pipe part 42*g* is disposed in a plane parallel to the X direction. A second virtual plane T2 is defined as a virtual plane including the central axis 42*n* of the main curved pipe part 42*g*. The second virtual plane T2 is inclined with respect to the reference plane CS.

The external suction pipe 43*a* of the third suction pipe 43 includes an upper straight pipe part 43*d*, a sub-curved pipe part 43*e*, an intermediate straight pipe part 43*f*, a main curved pipe part 43*g*, and a lower straight pipe part 43*h*. The upper straight pipe part 43*d* of the third suction pipe 43 is formed in the same manner as the upper straight pipe part 41*d* of the first suction pipe 41. The lower straight pipe part 43*h* of the third suction pipe 43 is formed in the same manner as the lower straight pipe part 41*h* of the first suction pipe 41.

The sub-curved pipe part 43*e* is disposed in the −Z direction of the upper straight pipe part 43*d*. The sub-curved pipe part 43*e* is curved from an end portion of the upper straight pipe part 43*d* in the −Z direction toward the reference plane CS. A central axis 43*n* of the sub-curved pipe part 43*e* is a curve that is curved in the +Y direction toward the −Z direction. The central axis 43*n* of the sub-curved pipe part 43*e* is disposed in a plane parallel to the YZ plane.

The intermediate straight pipe part 43*f* is disposed in the −Z direction of the sub-curved pipe part 43*e*. The intermediate straight pipe part 43*f* extends in the −Z direction and the +Y direction from an end portion of the sub-curved pipe part 43*e* in the −Z direction. The central axis 43*n* of the intermediate straight pipe part 43*f* is linear. The central axis 43*n* of the intermediate straight pipe part 43*f* is disposed in a plane parallel to the YZ plane.

The intermediate straight pipe part 43*f* is disposed between the sub-curved pipe part 43*e* and the main curved pipe part 43*g*. Thereby, the sub-curved pipe part 43*e* and the main curved pipe part 43*g* are easily formed with high accuracy.

The main curved pipe part 43*g* is disposed in the −Z direction of the intermediate straight pipe part 43*f*. The main curved pipe part 43*g* is curved from below the accumulator 50 toward the third suction port 28. The central axis 43*n* of the main curved pipe part 43*g* is a curve that is curved in the −X direction toward the −Z direction. The main curved pipe part 43*g* extends in the −Z direction and the +Y direction from an end portion of the intermediate straight pipe part 43*f* in the −Z direction. The central axis 43*n* of the main curved pipe part 43*g* is disposed in a plane parallel to the X direction. A third virtual plane T3 is defined as a plane including the central axis 43*n* of the main curved pipe part 43*g*. The third virtual plane T3 is inclined with respect to the reference plane CS.

As illustrated in FIG. 4, the second virtual plane T2 and the third virtual plane T3 are inclined to opposite sides from each other with respect to the reference plane CS. The second virtual plane T2 intersects the reference plane CS at the second opening center 42*p*. The second virtual plane T2 extends in the +Z direction and the +Y direction from the second opening center 42*p*. The third virtual plane T3 intersects the reference plane CS at the third opening center 43*p*. The third virtual plane T3 extends in the +Z direction and the −Y direction from the third opening center 43*p*.

Thereby, the second suction pipe 42 and the third suction pipe 43 are disposed on opposite sides from each other with respect to the reference plane CS on which the first suction pipe 41 is disposed. Therefore, the three suction pipes 41, 42, and 43 are efficiently laid out. Thereby, even when the second suction pipe 42 and the third suction pipe 43 are disposed close to each other to be made compact, interference between the three suction pipes 41, 42, and 43 is avoided. Also, even when flow path cross-sectional areas of the three suction pipes 41, 42, and 43 are expanded to reduce suction loss, interference between the three suction pipes 41, 42, and 43 is avoided. Also, a difference between a length of the second suction pipe 42 and a length of the third suction pipe 43 is reduced, and the suction loss is averaged.

An inclination angle of the second virtual plane T2 with respect to the reference plane CS is θ2. An inclination angle of the third virtual plane T3 with respect to the reference plane CS is θ3. At this time, θ2=θ3 is established. Thereby, the three suction pipes 41, 42, and 43 are efficiently laid out. Further, θ2<θ3 may also be established. Thereby, the main curved pipe part 43*g* of the third suction pipe 43 becomes more distant from the main curved pipe part 42*g* of the second suction pipe 42 in the −Z direction. Therefore, interference between the main curved pipe part 43*g* of the third suction pipe 43 and the main curved pipe part 42*g* of the second suction pipe 42 is avoided.

As illustrated in FIG. 2, a distance from a straight line connecting the second center 42*c* and the third center 43*c* to the first center 41*c* is L1. A distance between the second center 42*c* and the third center 43*c* is L2. At this time, L1<L2 is established. When L2 is increased, interference between the second suction pipe 42 and the third suction pipe 43 is avoided. Particularly, interference between the main curved pipe part 42*g* of the second suction pipe 42 and the main curved pipe part 43*g* of the third suction pipe 43 is avoided. On the other hand, when L1 is reduced, the three suction pipes 41, 42, and 43 are disposed close to each other, and the accumulator 50 is made compact. Further, the first suction pipe 41 is disposed closest to the compressor main body 10 in the X direction. The first suction pipe 41 is disposed between the second suction pipe 42 and the third suction pipe 43 in the Y direction. In the Z direction, the first suction pipe 41 is connected to the first suction port 26 in the most +Z direction. Therefore, even when L1 is small, interference of the second suction pipe 42 and the third suction pipe 43 with the first suction pipe 41 is avoided.

As illustrated in FIG. 5, a distance in the Z direction between the first opening center 41*p* and the second opening center 42*p* is P1. A distance in the Z direction between the second opening center 42*p* and the third opening center 43*p* is P2. At this time, P1<P2 is established. When P2 is increased, interference between the second suction pipe 42 and the third suction pipe 43 is avoided. Particularly, interference between the main curved pipe part 42*g* of the second suction pipe 42 and the main curved pipe part 43*g* of the third suction pipe 43 is avoided. On the other hand, when P1 is reduced, the compressor main body 10 is made compact in the Z direction. Further, the first suction pipe 41 is disposed closest to the compressor main body 10 in the X direction. The first suction pipe 41 is disposed between the second suction pipe 42 and the third suction pipe 43 in the Y direction. In the Z direction, the first suction pipe 41 is connected to the first suction port 26 in the most +Z direction. Therefore, even when P1 is small, interference of the second suction pipe 42 and the third suction pipe 43 with the first suction pipe 41 is avoided.

L2<P1 is established between L2 illustrated in FIG. 2 and P1 illustrated in FIG. 5. A high-pressure refrigerant after compression is sealed inside the case 11 of the compressor main body 10. When P1 is increased, an intermediate portion between the first suction port 26 and the second suction port 27 becomes longer, and a cross-sectional area of the case 11 in the portion becomes larger. Therefore, pressure resistance of the case 11 is improved. When L2 is reduced, the three suction pipes 41, 42, and 43 are disposed close to each other, and the accumulator 50 is made compact. Further, a low-pressure refrigerant before compression is sealed inside the accumulator 50. Therefore, even when an intermediate portion between the second suction pipe 42 and the third suction pipe 43 is short, pressure resistance of the accumulator 50 is secured.

As described in detail above, the compressor 2 of the embodiment includes the three suction pipes 41, 42, and 43. The three suction pipes 41, 42, and 43 includes the main curved pipe parts 41*g*, 42*g*, and 43*g* that are curved from below the accumulator 50 toward the three suction ports 26, 27, and 28. The second virtual plane T2 and the third virtual plane T3 are inclined to opposite sides from each other with respect to the reference plane CS. The reference plane CS is a plane on which the central axis 41*n* of the main curved pipe part 41*g* of the first suction pipe 41 is disposed. The second virtual plane T2 is a plane on which the central axis 42*n* of the main curved pipe part 42*g* of the second suction pipe 42 is disposed. The third virtual plane T3 is a plane on which the central axis 43*n* of the main curved pipe part 43*g* of the third suction pipe 43 is disposed.

Thereby, the three suction pipes 41, 42, and 43 are efficiently laid out. Even when the second suction pipe 42 and the third suction pipe 43 are disposed close to each other to be made compact, interference between the three suction pipes 41, 42, and 43 is avoided. Even when flow path cross-sectional areas of the three suction pipes 41, 42, and 43 are expanded to reduce a suction loss, interference between the three suction pipes 41, 42, and 43 is avoided. Therefore, the compressor 2 is made compact.

The second suction pipe 42 and the third suction pipe 43 include the upper straight pipe parts 42*d* and 43*d*, the lower straight pipe parts 42*h* and 43*h*, the sub-curved pipe parts 42*e* and 43*e*, and the intermediate straight pipe parts 42*f* and 43*f*. The upper straight pipe parts 42*d* and 43*d* penetrate the bottom portion of the accumulator 50. The lower straight pipe parts 42*h* and 43*h* are connected to the suction ports 27 and 28 of the case 11. The sub-curved pipe parts 42*e* and 43*e* are curved from the lower ends of the upper straight pipe parts 42*d* and 43*d* toward the reference plane CS. The intermediate straight pipe parts 42*f* and 43*f* are disposed between the sub-curved pipe parts 42*e* and 43*e* and the main curved pipe parts 42*g* and 43*g*.

Thereby, starting points of both end portions of the sub-curved pipe part 42*e* and the main curved pipe part 42*g* become clear. Therefore, the sub-curved pipe part 42*e* and the main curved pipe part 42*g* are formed with high accuracy at a low cost.

A distance from the straight line connecting the second center 42*c* and the third center 43*c* to the first center 41*c* is L1. A distance between the second center 42*c* and the third center 43*c* is L2. At this time, L1<L2 is established.

When L2 is increased, interference between the second suction pipe 42 and the third suction pipe 43 is avoided. When L1 is reduced, the three suction pipes 41, 42, and 43 are disposed close to each other while avoiding interference between the three suction pipes 41, 42, and 43. Therefore, the accumulator 50 is made compact.

A distance in the Z direction between the first opening center 41*p* at the lower end portion (end portion in the −Z direction and −X direction) of the first suction pipe 41 and the second opening center 42*p* at the lower end portion of the second suction pipe 42 is P1. A distance in the Z direction between the second opening center 42*p* at the lower end portion of the second suction pipe 42 and the third opening center 43*p* at the lower end portion of the third suction pipe 43 is P2. At this time, L2<P1<P2 is established.

When P2 is increased, interference between the second suction pipe 42 and the third suction pipe 43 is avoided. When P1 is reduced, the compressor main body 10 is made compact in the Z direction while avoiding interference between the three suction pipes 41, 42, and 43. Also, when P1 is increased, pressure resistance of the case 11 is improved. When L2 is reduced, the three suction pipes 41, 42, and 43 are disposed close to each other while securing pressure resistance of the accumulator 50. Therefore, the accumulator 50 is made compact.

The three suction ports 26, 27, and 28 are disposed to overlap the reference plane CS as viewed from above the accumulator 50.

Thereby, the three suction pipes 41, 42, and 43 are connected to the three suction ports 26, 27, and 28 from the same direction. Therefore, connection work of the three suction pipes 41, 42, and 43 is simplified.

The refrigeration cycle device 1 of an embodiment includes the compressor 2, the radiator 3, the expansion device 4, and the heat absorber 5 described above. The radiator 3 is connected to the compressor 2. The expansion device 4 is connected to the radiator 3. The heat absorber 5 is connected to the expansion device 4.

The compressor 2 described above is made compact. Therefore, the compact refrigeration cycle device 1 is provided.

The reference plane CS of the embodiment is defined as a virtual plane including the central axis 41*n* of the main curved pipe part 41*g*. On the other hand, the reference plane CS may also be defined as a plane including a central axis 10*z* of the compressor main body 10 and the first opening center 41*p* (see FIG. 5) as illustrated in FIG. 2. A center connection line CL is defined as a straight line passing through the center 10*c* of the compressor main body 10 and the center 50*c* of the accumulator 50. The reference plane CS may also be defined as the XZ plane including the center connection line CL. In other words, the reference plane CS may also be defined as a plane including the central axis 10*z* of the compressor main body 10 and a central axis 50*z* of the accumulator 50.

The first suction pipe 41 is disposed to satisfy the following. As illustrated in FIG. 3, the first flow path cross section 41*s* of the first suction pipe 41 overlaps the center connection line CL as viewed from the +Z direction. In other words, the first flow path cross section 41*s* of the first suction pipe 41 intersects the reference plane CS. At least a part of the first flow path cross section 41*s* may overlap the center connection line CL.

The second suction pipe 42 and the third suction pipe 43 are disposed to satisfy the following. As illustrated in FIG. 3, as viewed from the +Z direction, the second flow path cross section 42*s* of the second suction pipe 42 and the third flow path cross section 43*s* of the third suction pipe 43 are disposed on opposite sides of the center connection line CL (or the reference plane CS) sandwiched therebetween. In the example of FIG. 3, the second flow path cross section 42*s* is positioned in the +Y direction of the center connection line CL, and the third flow path cross section 43*s* is positioned in the −Y direction of the center connection line CL. A second separation distance from the second flow path cross section 42*s* to the center connection line CL and a third separation distance from the third flow path cross section 43*s* to the center connection line CL may be different. In the example of FIG. 3, the second separation distance and the third separation distance are the same. In the example of FIG. 3, the triangle TR is line-symmetric with respect to the center connection line CL.

The first suction pipe 41 of the embodiment has the following configuration. The first suction pipe 41 is disposed closer to the compressor main body 10 than the second suction pipe 42 and the third suction pipe 43 are. When viewed from the +Z direction, the first flow path cross section 41*s* of the first suction pipe 41 overlaps the center connection line CL. The first suction pipe 41 is connected to the first suction port 26 which is positioned uppermost among the three suction ports 26, 27, and 28. When viewed from the +Z direction, the first suction port 26 overlaps the center connection line CL.

Thereby, a length of the first suction pipe 41 decreases. Therefore, heat loss of a gaseous refrigerant flowing through the first suction pipe 41 decreases, and thus efficiency of the compressor 2 is improved. Also, as illustrated in FIG. 1, the first suction pipe 41 has a simple shape that is curved only two-dimensionally. Therefore, material costs and processing costs of the first suction pipe 41 are suppressed.

The second suction pipe 42 and the third suction pipe 43 of the embodiment have the following configurations. The second suction pipe 42 and the third suction pipe 43 are disposed farther from the compressor main body 10 than the first suction pipe 41 is. When viewed from the +Z direction, the second flow path cross section 42*s* of the second suction pipe 42 and the third flow path cross section 43*s* of the third suction pipe 43 are positioned on opposite sides of the center connection line CL sandwiched therebetween. The third suction pipe 43 is connected to the third suction port 28 of the third compression mechanism unit 23 positioned lowermost. The second suction pipe 42 is connected to the second suction port 27 of the second compression mechanism unit 22 positioned in the middle in the Z direction. When viewed from the +Z direction, the second suction port 27 and the third suction port 28 overlap the center connection line CL.

Thereby, as illustrated in FIG. 4, the second suction pipe 42 and the third suction pipe 43 have a three-dimensionally curved shape. Even in this case, since the second suction pipe 42 and the third suction pipe 43 are disposed far from the compressor main body 10, curved shapes thereof are gently and smoothly realized. Also, since the second suction pipe 42 and the third suction pipe 43 are positioned on opposite sides of the center connection line CL sandwiched therebetween, lengths thereof are not unnecessarily large. Therefore, material costs and processing costs of the second suction pipe 42 and the third suction pipe 43 are suppressed.

The compressor 2 of the embodiment is a so-called rotary-type compressor. On the other hand, the compressor 2 may be a compressor of another type.

According to at least one embodiment described above, the second virtual plane T2 and the third virtual plane T3 are inclined to opposite sides from each other with respect to the reference plane CS. Thereby, the compressor 2 can be made compact.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A compressor comprising:

a compressor main body which houses a plurality of compression mechanism units and an electric motor unit driving the plurality of compression mechanism units in a case;

an accumulator supported by the compressor main body and including a refrigerant introduction part at an upper portion thereof; and three suction pipes penetrating a bottom portion of the accumulator, having one end sides which open inside the accumulator, and having the other end sides connected to three suction ports provided in the case, wherein the three suction pipes are a first suction pipe, a second suction pipe, and a third suction pipe, the three suction pipes are disposed at a portion penetrating the bottom portion of the accumulator so that a first center of a first flow path cross section of the first suction pipe, a second center of a second flow path cross section of the second suction pipe, and a third center of a third flow path cross section of the third suction pipe are positioned at vertices of a triangle with all three angles acute as viewed from above the accumulator, the first suction pipe is disposed so that a first distance between the first center and a center of the compressor main body is smaller than a second distance between the second center and the center of the compressor main body and a third distance between the third center and the center of the compressor main body, the other end side of the first suction pipe is connected to a first suction port which is positioned uppermost among the three suction ports, the three suction pipes include main curved pipe parts which are curved from below the accumulator toward the three suction ports, a second virtual plane on which a central axis of the main curved pipe part of the second suction pipe is disposed and a third virtual plane on which a central axis of the triam curved pipe part of the third suction pipe is disposed are inclined to opposite sides from each other with respect to a first virtual plane on which a central axis of the main curved pipe part of the first suction pipe is disposed, the other end side of the third suction pipe is connected to a third suction port which is positioned lowermost among the three suction ports, $\theta 2<\theta 3$ is established when an inclination angle of the second virtual plane with respect to the first virtual plane is $\theta 2$ and an inclination angle of the third virtual plane with respect to the first virtual plane is $\theta 3$, and a center of the accumulator is located on the first virtual plane, and inside the triangle whose vertices are the first center, the second center, and the third center on the bottom surface of the accumulator.

2. The compressor according to claim 1, wherein the second suction pipe and the third suction pipe each include:

an upper straight pipe part penetrating the bottom portion of the accumulator;

a lower straight pipe part connected to the suction port of the case;

a sub-curved pipe part curved from a lower end of the upper straight pipe part toward the first virtual plane; and an intermediate straight pipe part disposed between the sub-curved pipe part and the main curved pipe part.

3. The compressor according to claim 1, wherein, when a distance from a straight line connecting the second center and the third center to the first center is L1 and a distance between the second center and the third center is L2, L1<L2 is established.

4. The compressor according to claim 3, wherein, when a distance between a first opening center on the other end side of the first suction pipe and a second opening center on the other end side of the second suction pipe along a central axis of the compressor main body is P1 and a distance between the second opening center on the other end side of the second suction pipe and a third opening center on the other end side of the third suction pipe along the central axis of the compressor main body is P2, L2<P1<P2 is established.

5. The compressor according to claim 1, wherein the three suction ports are disposed to overlap the first virtual plane as viewed from above the accumulator.

6. A refrigeration cycle device comprising:

the compressor according to claim 1;

a radiator connected to the compressor;

an expansion device connected to the radiator; and a heat absorber connected to the expansion device.

* * * * *